United States Patent [19]

Patel

[11] Patent Number: 4,582,014

[45] Date of Patent: Apr. 15, 1986

[54] VESSEL HAVING STABILIZING SYSTEM

[76] Inventor: Minoo H. E. Patel, 39 Cumberland Drive, Basildon, Essex, England

[21] Appl. No.: 560,887

[22] Filed: Dec. 14, 1983

Related U.S. Application Data

[63] Continuation-in-part of Ser. No. 339,755, Jan. 15, 1982, abandoned.

[51] Int. Cl.[4] ..... B63B 43/06

[52] U.S. Cl. ..... 114/125; 114/265; 114/122

[58] Field of Search ..... 114/121, 122, 125, 264, 114/265

[56] References Cited

U.S. PATENT DOCUMENTS

| | | | |
|---|---|---|---|
| 1,220,551 | 3/1917 | Powell | 114/122 |
| 2,889,795 | 6/1959 | Parks | 114/125 |
| 3,391,666 | 7/1968 | Schuller, Jr. | 114/122 |
| 3,537,412 | 11/1970 | Henderson | 114/125 |
| 4,176,614 | 12/1979 | Goss et al. | 114/125 |

FOREIGN PATENT DOCUMENTS

| | | | |
|---|---|---|---|
| 52404 | 10/1911 | Fed. Rep. of Germany | 114/125 |
| 329278 | 5/1919 | Fed. Rep. of Germany | 114/125 |
| 561379 | 9/1932 | Fed. Rep. of Germany | 114/125 |
| 1067339 | 5/1967 | United Kingdom | 114/125 |

*Primary Examiner*—Trygve M. Blix
*Assistant Examiner*—Edwin L. Swinehart
*Attorney, Agent, or Firm*—McAulay, Fields, Fisher, Goldstein & Nissen

[57] ABSTRACT

A vessel, for example a semi-submersible is provided with at least a chamber for stabilizing it against any or all of heave, roll and pitch. The chambers are mounted on or in the vessel and disposed to lie at least partly below the surface of the water. Valves are provided for controlling the buoyancy of the chambers. Each valve has a first position in which the respective chamber is connected to atmosphere to permit air to enter or leave the chamber, and a second position in which the chamber is not so connected.

8 Claims, 16 Drawing Figures

Fig. 13 VESSEL OPERATING WITH HEAVE CANS

VESSEL HAVING STABILIZING SYSTEM

This application is a continuation-in-part of U.S. Ser. No. 339,755 filed Jan. 15, 1982, now abandoned.

This invention relates to vessels having stabilizing means.

Various methods have been proposed for stabilizing vessels. One method is to provide the vessel with roll control tanks. Two interconnected tanks are provided on opposite sides of the vessel, the interconnection between the tanks including an energy-dissipating throttle. Pitch control may be similarly provided by means of two interconnected tanks spaced longitudinally of one another within the vessel. Such roll and pitch control devices are of limited effectiveness and, furthermore, they are incapable of providing stabilization against heave.

Another known method of attempting to stabilize against roll involves the use of movable wings at the bow end of a movable vessel. Because of the presence of these wings forward motion of the vessel generates lift, and the attitude of the wings can be changed in response to changes in the attitude of the ship with a view to providing stabilization. This method is unsatisfactory because it relies on the existence of a reasonable forward speed, and is thus inoperable when the vessel is stationary or only travelling slowly. Furthermore, such wings cannot provide stabilization against heave.

According to the present invention there is provided a vessel having stabilizing means for alleviating at least heave, comprising at least one chamber disposed to lie at least partly beneath the surface of the water when at least a portion of the vessel is immersed in water, said chamber having an opening communicating with the water to allow the exit or entrance of water out of or into the chamber and valve means for controlling the buoyancy of said chamber, the valve means being selectively movable to a first position in which said chamber is connected to atmosphere to permit air to enter or leave said chamber in response to the lowering or rising of the water level in said chamber due to wave action, and a second position in which said chamber is not so connected. The valve means are arranged to be maintained in the selected position through a substantial number of wave cycles.

Preferably there are at least two spaced apart chambers.

For the purposes of this specification the term vessel includes reference to any structure capable of floating in water or sea water whether in an immersed or semi-immersed mode, for example, ships, barges, rafts, semi-submersibles and submersibles, as well as tethered structures such as tensioned buoyant platforms.

The chamber may be disposed in the vessel such that the stabilizing means stabilizes the vessel against heave and/or pitch and/or roll.

Embodiments of the invention will now be described with reference to the accompanying drawings, in which.

FIG. *7a* is a schematic side view of another embodiment of the invention;

FIG. *7b* is a section on line X—X in FIG. *7a;*

Figure 8:
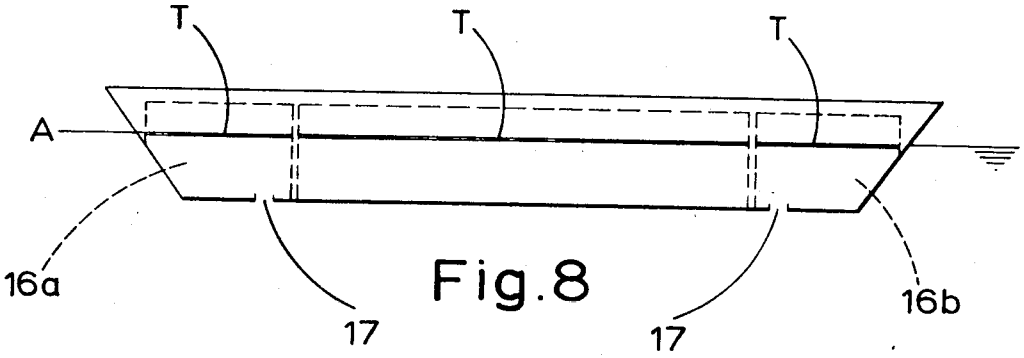
Figure 10:
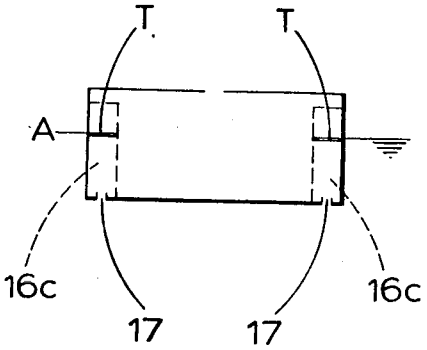
Figure 9:
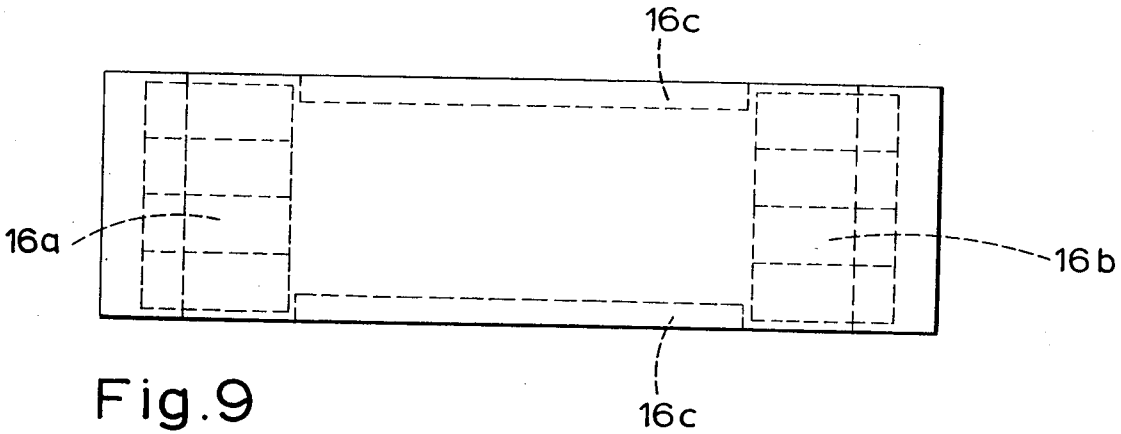
Figure 11:
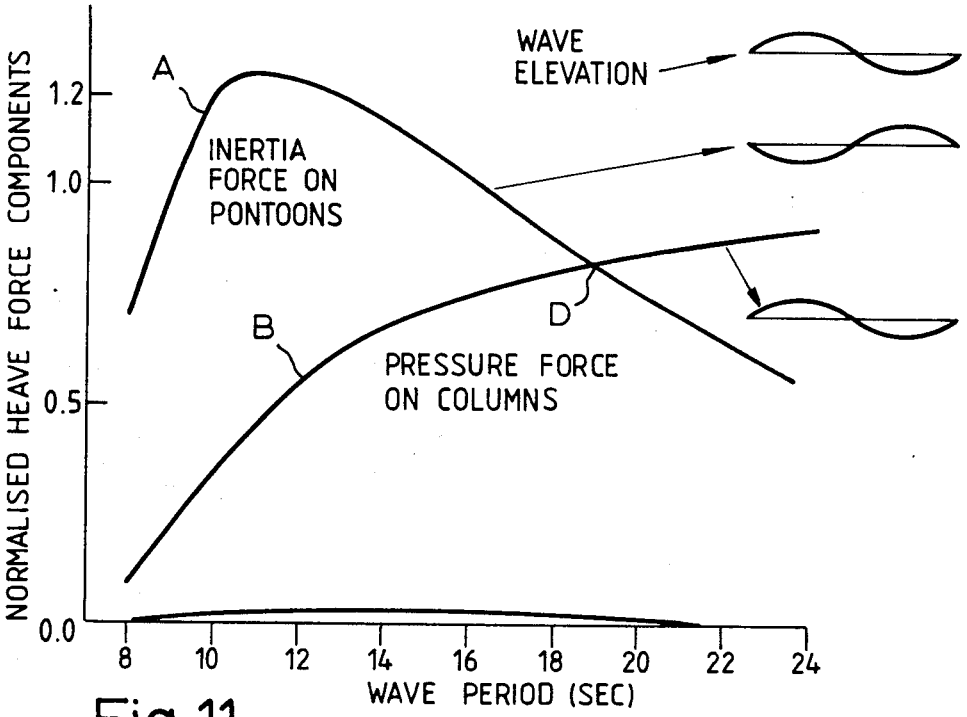
Figure 12:
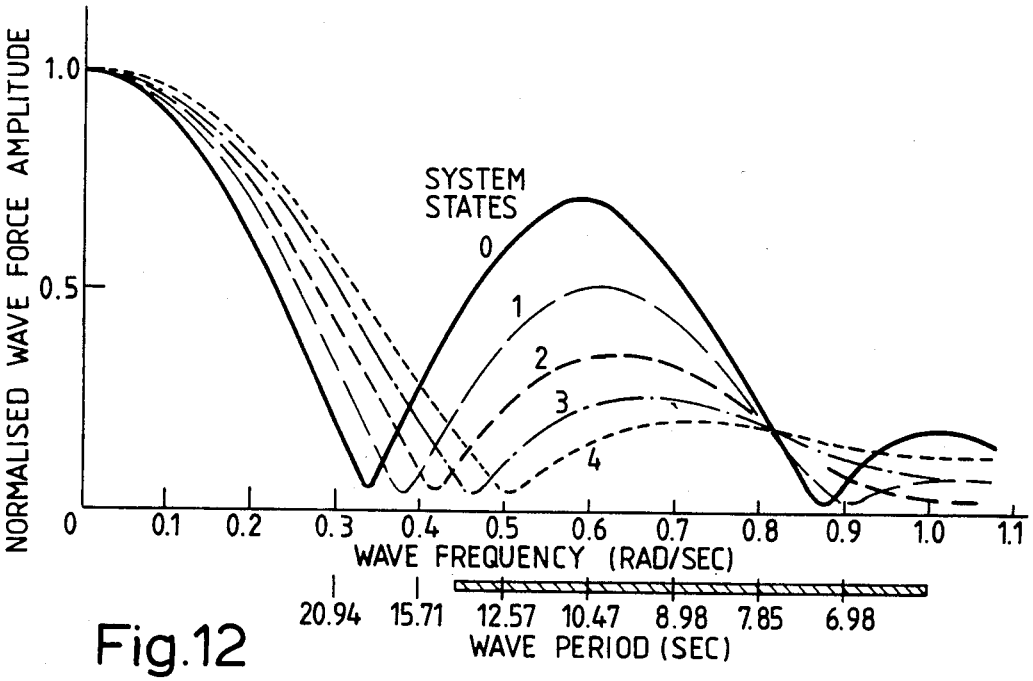
Figure 13:
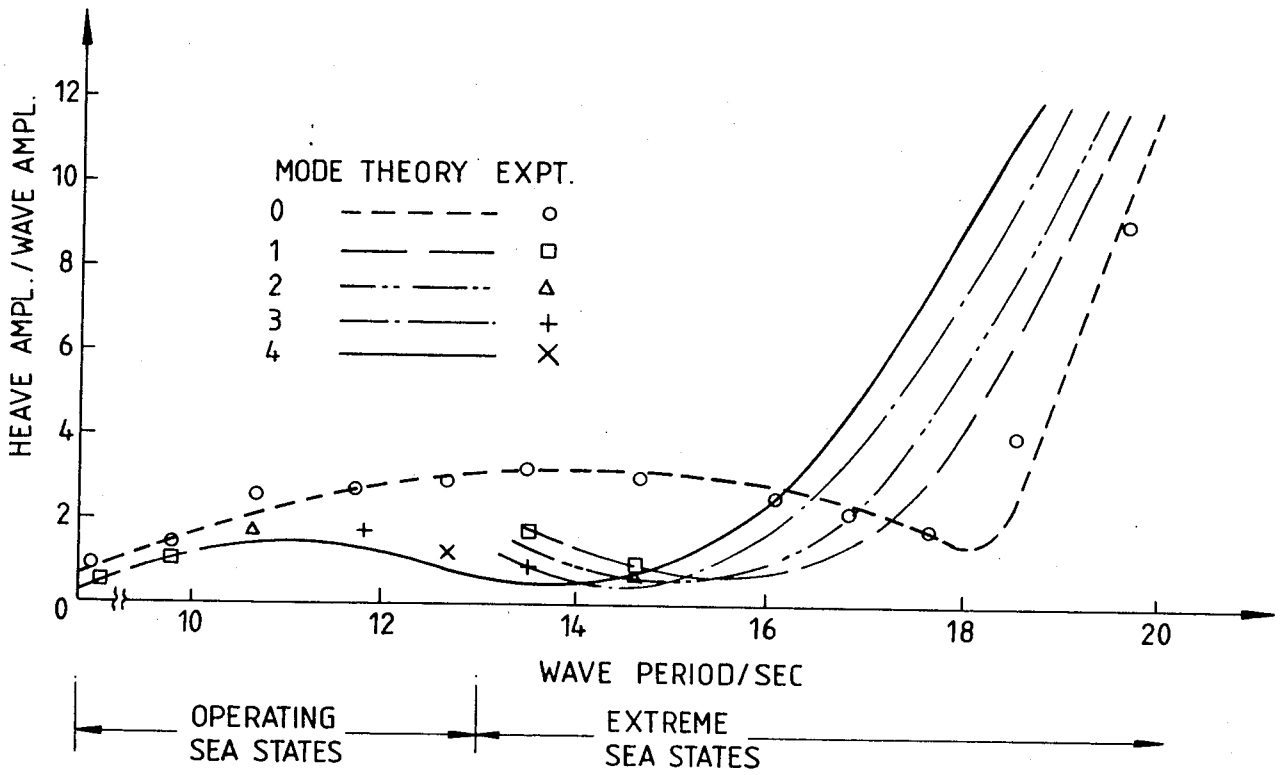
Figure 14:
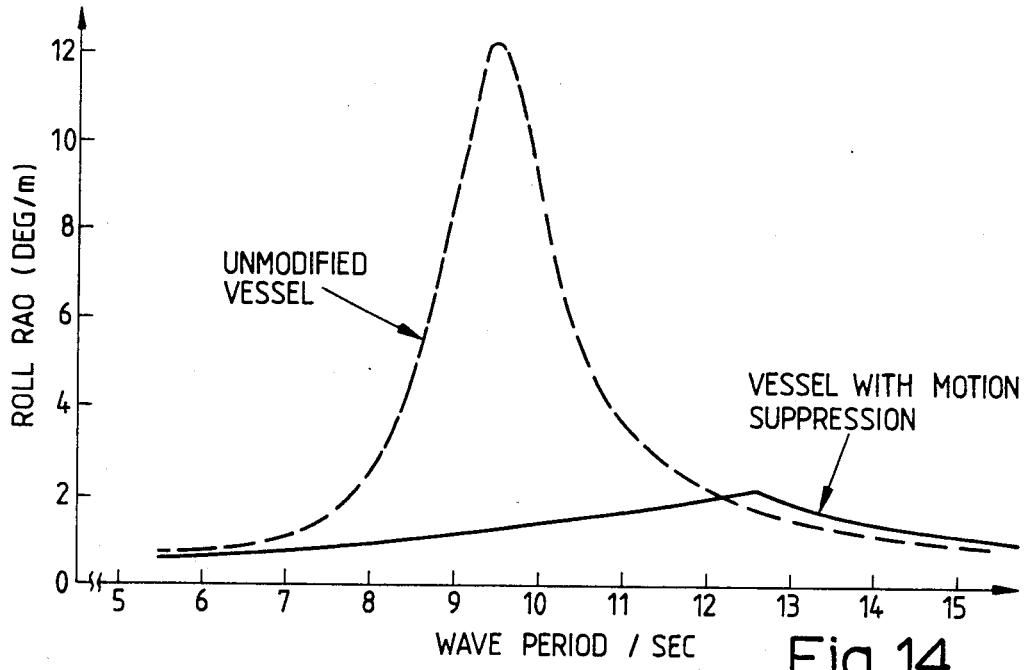
Figure 15:
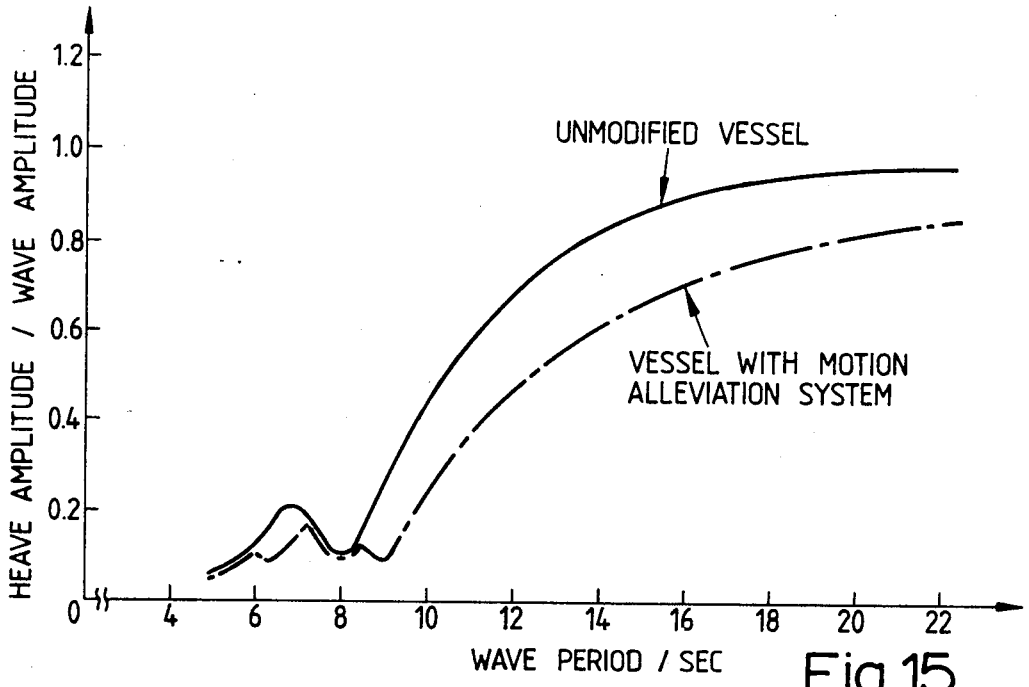

FIG. 8 is a schematic view of a barge or monohull provided with stabilizing means;

FIG. 9 is a schematic plan view of the barge or monohull of FIG. 8;

FIG. 10 is a schematic cross-section through the barge or monohull of FIGS. 8 and 9;

FIG. 11 is a graph showing the normalised heave force components acting on a semi-submersible vessel plotted against wave period;

FIG. 12 is a graph showing the effect of the invention on heave force amplitude;

FIG. 13 is a graph showing the improvement in heave motion amplitude of a vessel (expressed as the ratio of heave amplitude to wave amplitude) as a function of wave period;

FIG. 14 is a graph showing the roll motion response (expressed as the ratio of roll amplitude in degrees to wave amplitude in metres) as a function of wave period, in beam seas;

FIG. 15 is a graph showing the heave motion response (expressed as the ratio of heave amplitude to wave amplitude) as a function of wave period, in head seas.

Figure 1:
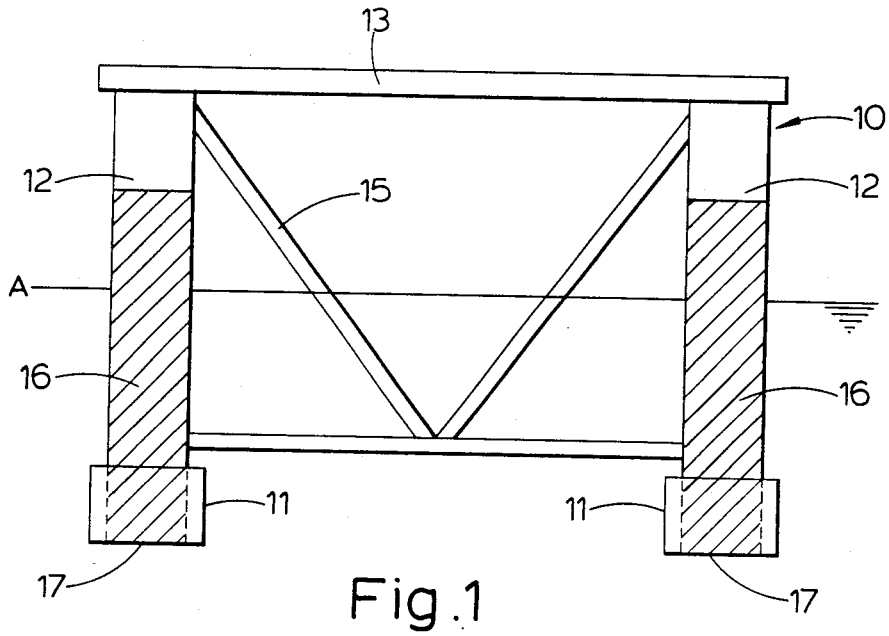
FIG. 1 is a schematic end view of a semi-submersible having stabilizing means.
Figure 2:
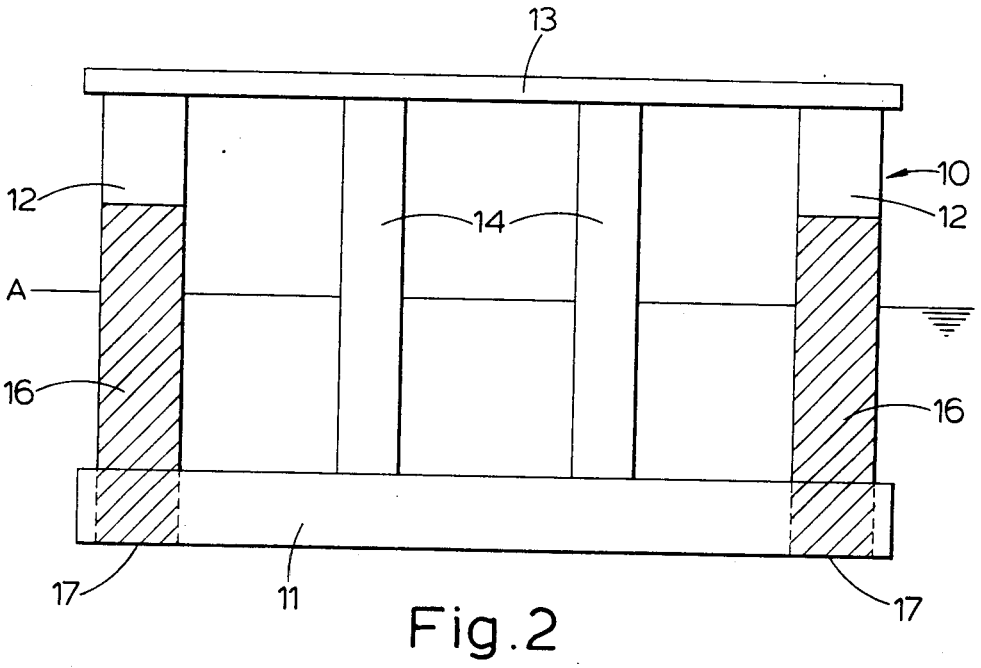
FIG. 2 is a schematic side view of the semi-submersible of FIG. 1.

FIGS. 1 and 2 show a semi-submersible vessel generally indicated at 10. The vessel comprises a pair of parallel pontoons 11, four outer support columns 12 mounted at the respective ends of pontoons 11 and a platform 13 secured to the upper ends of the outer support columns 12 to bridge the pontoons 11. The platform 13 is further supported by inner support columns 14 which are spaced along the pontoons 11. A frame structure, a part of which is indicated at 15, extends between at least some of the adjacent pairs of columns 12, 14 to provide the vessel with lateral rigidity.

Each outer support column 12 has a chamber 16 formed in its lower portion. In FIGS. 1 and 2 the chambers 16 are shaded. Each chamber 16 is open at its lower end 17 such that when the vessel 10 is semi-submerged in water, as shown in FIGS. 1 and 2, the water is free to enter the chamber 16 through its open lower end 17. Instead of the open lower end 17, a plurality of symmetrically arranged side openings may be provided. Both such arrangements make the system insensitive to the direction from which the waves are incident on the vessel, sensitivity to wave direction being undesirable. The solid line A in FIGS. 1 and 2 indicates the still water level. The chambers 16 are dimensioned such that when the vessel 10 is an equilibrium in still water, as shown in FIGS. 1 and 2, the chambers 16 will be partly filled with water to a level which coincides with line A.

Each chamber is provided with a valve (not shown) which, is selectively movable to a first position in which the chamber is connected to atmosphere to permit air to enter or leave the chamber, and a second position in which the chamber is not so connected.

Figure 3:
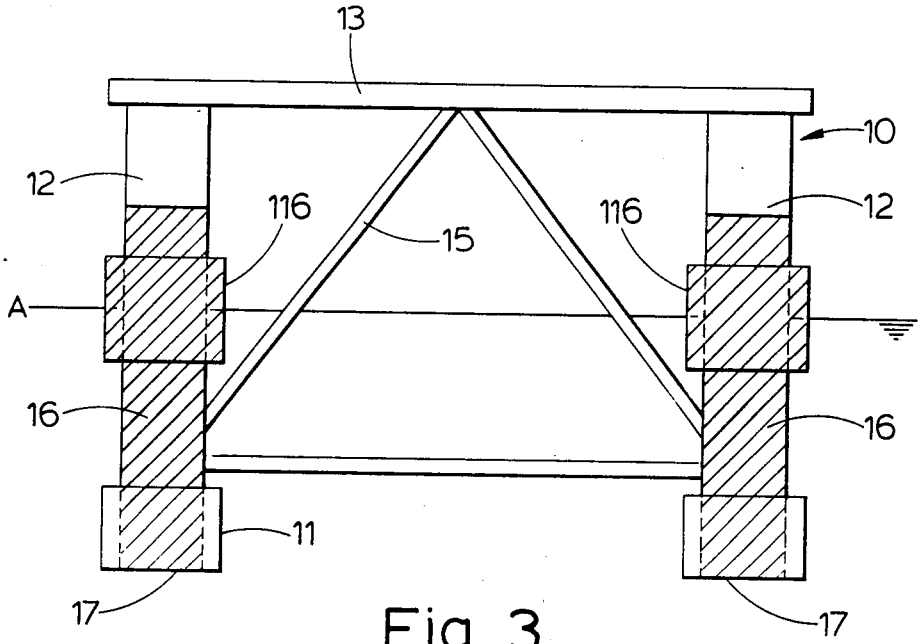
FIG. 3 is a schematic end view of a semi-submersible having an alternative form of stabilizing means.
Figure 4:
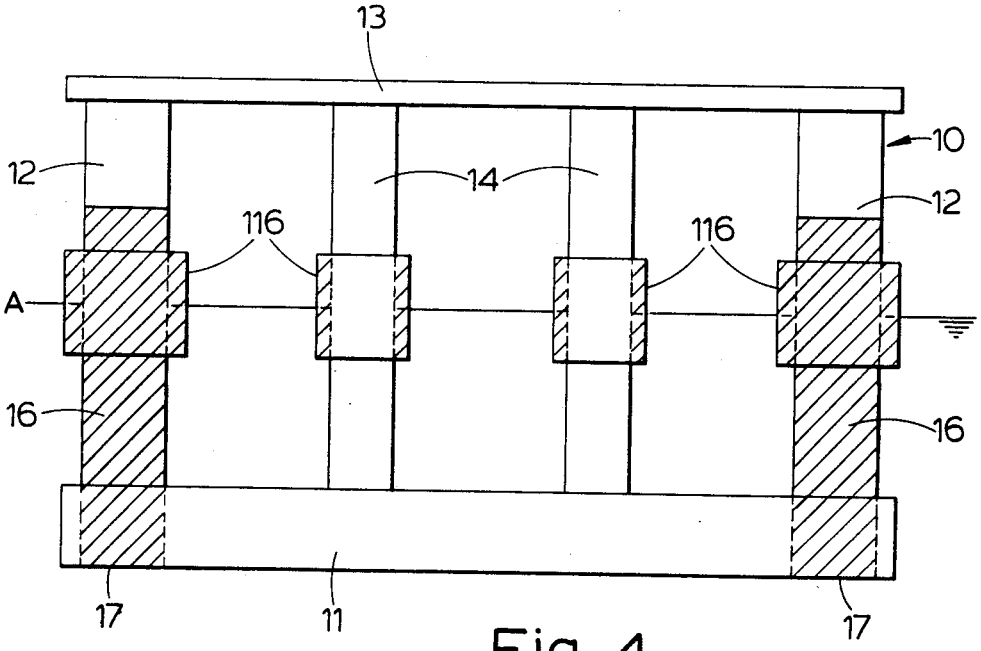
FIG. 4 is a schematic side view of the semi-submersible of FIG. 3.

In the embodiment shown in FIGS. 3 and 4, in addition to locating the buoyancy chambers 16 within the support columns 12, buoyancy chambers 116 are placed outside the vessel, for example as concentric circular collars on the vertical cylindrical columns. Any appropriate number of such external buoyancy chambers may be present, with eight chambers being used for the embodiment of FIGS. 3 and 4. It is to be understood that the external chambers could be used instead of, rather than in addition to, the internal buoyancy chambers. A commercial advantage exists in placing the buoyancy chambers outside the vessel since currently operating vessels can be retro-fitted with stabilizing means according to the invention. A concentric circular collar is only one possibility for buoyancy chamber placement outside the vessel hull. Very many other alternative external buoyancy chamber positions can be used. A secondary effect of certain external buoyancy chamber attachments is to allow a substantial increase in deck payload over and above the payload of the unmodified vessel.

Both the external buoyancy chambers 116 and the internal buoyancy chambers 16 are disposed partially below and partially above the still water level.

Figure 5:
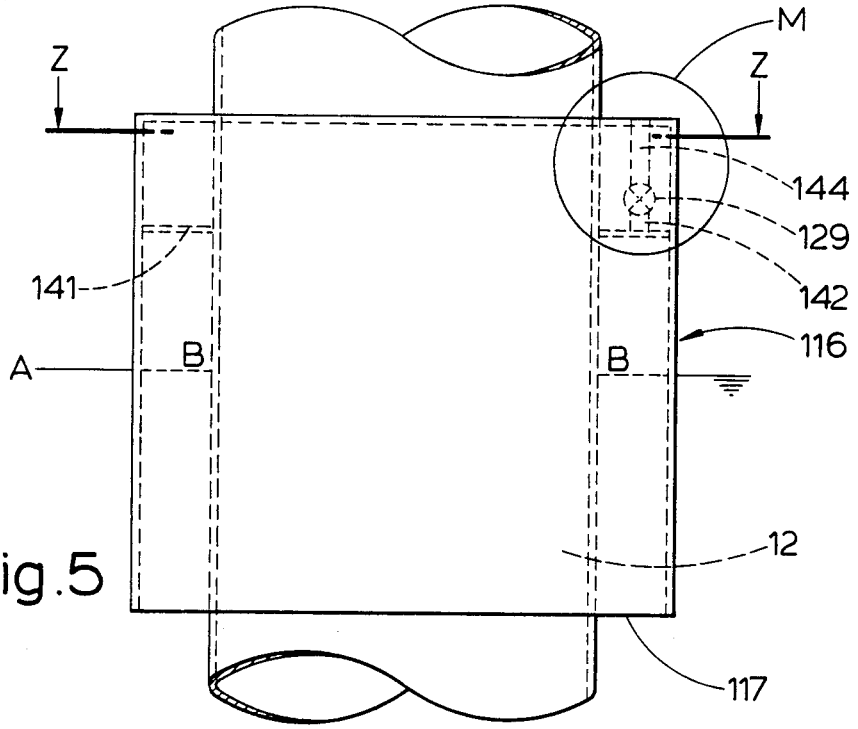
FIG. 5 is a more detailed view of one of the buoyancy chambers shown in FIGS. 3 and 4.
Figure 6:
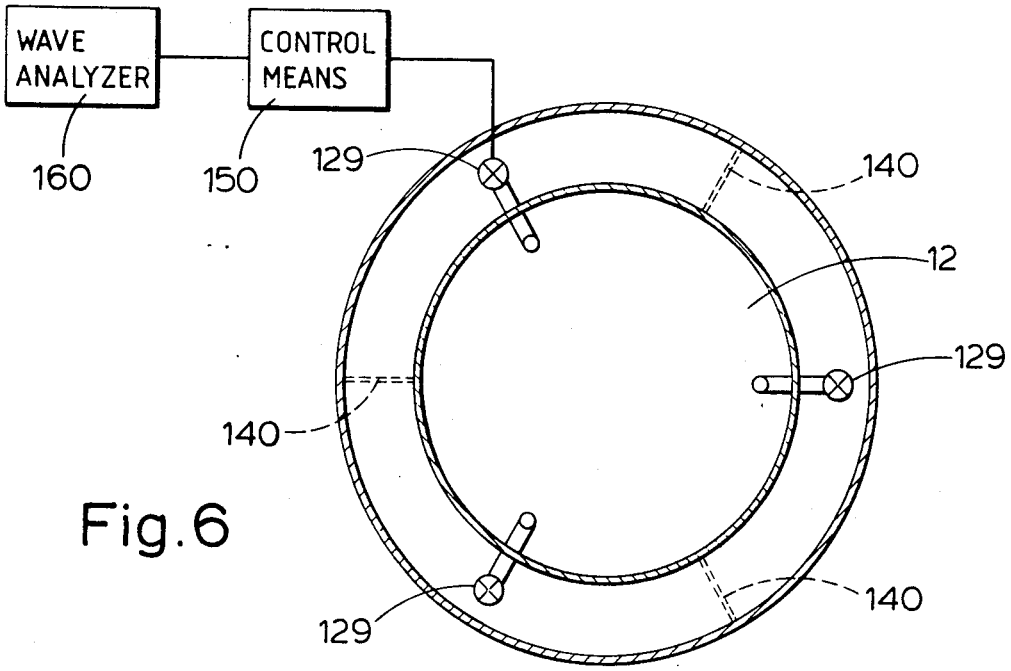
FIG. 6 is a section on line Z—Z in FIG. 5.
Figure 7A:
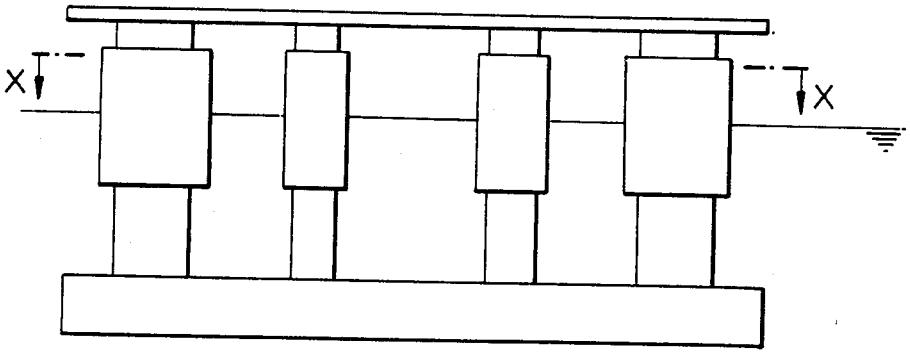
Figure 7B:
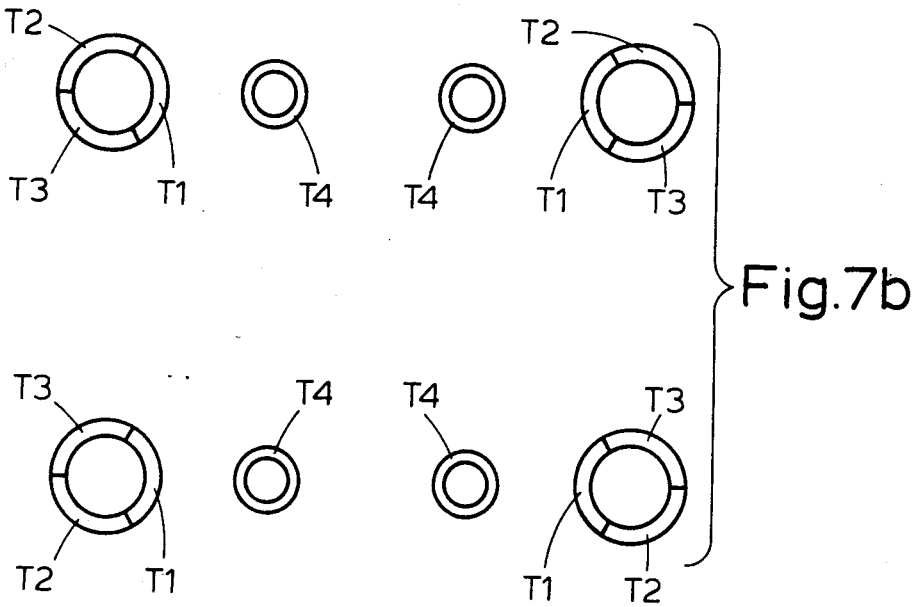

FIGS. 5 and 6 show in more detail the construction of one of the chambers 116. The chamber is open to the sea at its lower end 117 or through a plurality of symmetrically arranged side openings. The chamber is divided into three compartments by partitions 140 which extend vertically downwards from a horizontal bulkhead 141 to the lower end 117. The partitions are not essential but assist in stabilization control because the annular chamber 116 can be treated as three separate compartments. A valve 129 controls air flow through a duct 142 communicating with the top of the compartment. The duct 142 leads through valve 129 to a pipe 144 which communicates with atmosphere. The detail shown in circle M is repeated for each of the compartments.

It is noted at this point that although the division of a buoyancy chamber is shown in FIGS. 5 and 6 in connection with an external buoyancy chamber it is equally applicable to an internal buoyancy chamber.

The way in which the systems described above operate is that the valves are connected to a control means (indicated as 150 in FIG. 6) which moves them to a fully open position (in which the valve concerned allows the buoyancy chamber to communicate with atmosphere) or a fully closed position. It will be appreciated that if a given valve is open and the water level in the corresponding chamber is forced to rise by wave action, then the air trapped in the upper part of the chamber may freely leave the chamber to atmosphere so that the rise in water level in the chamber is substantially unimpeded. On the other hand, if the water level in the chamber is forced to fall by wave action, interconnection by the valve to atmosphere will allow the water level in the chamber to fall without substantial impediment. If, however, a given valve is shut then if the water level in the corresponding chamber attempts to rise or fall any such rise or fall can only be effected against a counteracting force produced by compression or expansion of the trapped air within the upper part of the chamber. Thus, in this case the rise or fall in water level within the chamber is impeded. In this way, and as described in more detail below, operation of the valves controls the buoyancy variations in the chambers and provides corresponding stabilization.

The valves are opened or closed by a control means, indicated by way of example in FIG. 6 by reference numeral 150. The control means 150 can be operated manually to take account of observed wave conditions. Alternatively, the control means 150 may be operated by a wave analyzer 160 which is designed to compute the peak frequency and the spectra of the vessel heave, roll and pitch motions that are occurring. A preset 'look up' table is then referred to within the analyzer to read the optimum valve fully open or fully shut configuration for maximum motion alleviation. This configuration is transmitted to the valves as commands for valve operation. Where the analyzer 160 is employed a manual override and valve configuration monitor facilites may be provided to allow the vessel master a measure of authority over selected valve configuration.

It is to be noted that the valve configuration will change from open to shut or vice versa only as a result of a change in the wave conditions in which the vessel is operating. Such conditions normally change only relatively slowly, so that one could expect a significant number of wave cycles to pass between successive changes in valve configuration.

The theory underlying the invention will now be described.

A typical column stabilised semi-submersible without the stabilizing system of the invention will have wave induced heave force amplitudes as presented in FIG. 11 for a regular wave of 1 m amplitude. The heave force amplitude is split into inertia forces on the pontoons (curve A), wave pressure forces on the columns (curve B) and vertical drag forces (curve C). The phase angle of the wave elevation, the pontoon inertia force and the column wave pressure force are shown. These phases are such that an almost complete wave force cancellation (except for the drag force) occurs at a wave period of 18.7 seconds (point D) when the inertia forces on the pontoons and the unbalanced vertical wave pressure forces on the columns add up to a nearly zero amplitude. Thus in the region of typical wave frequencies, since the inertia force on the pontoons is greater, the total wave force is approximately 180 degrees out of phase with the wave elevation.

What the stabilizing system of the invention does is to provide a means for inducing a variable force amplitude which is in phase with the wave elevation, thereby providing the potential for substantially reducing the heave force (and therefore the roll and pitch moments also) on the vessel at wave frequencies.

By way of example consider the system shown in FIGS. *7a* and *7b* which comprises eight, externally mounted buoyancy chambers, of which the four largest are each divided into tanks T1, T2 and T3 and the four smallest each consist of a single tank T4. There are five possible system states, which are:

| State | Vessel Configuration |
|---|---|
| 0 | All vent valves to tanks T1, T2, T3 and T4 are open |
| 1 | Vent valves to tanks T4 are shut |
| 2 | Vent valves to tanks T1 and T4 only are shut |
| 3 | Vent valves to tanks T1, T2 and T4 are shut |
| 4 | All vent valves to tanks T1, T2, T3 and T4 are shut |

The effect of moving from system states 0 to 4 is to progressively increase the effectiveness of the system. The effect of this on the heave force amplitude due to waves is illustrated in FIG. 12 which shows normalised heave force amplitude plotted against wave frequency for system states 0, 1, 2, 3 and 4. The 6 to 14 second range of predominant wave periods is also shown shaded on the horizontal axis.

It is clear from this figure that a substantial drop in heave force amplitude is obtained over the predominant wave period range as the motion suppression system is progressively brought into action from system states 0 to 4. In practice, it is unlikely that one would want the facility of being able to use States 1, 2 and 3 above, and the example is included primarily to illustrate the theory underlying the invention.

FIG. 13 shows the set of available heave response amplitude operators (RAOS), i.e. ratio of heave amplitude to wave amplitude, each of which can be activated by setting the valves to the appropriate 0, 1, 2, 3 or 4 configuration. Configuration 0 has all vent valves open and the vessel behaves almost identically to the unmodified design with no motion suppression. The heave RAO for configuration 4 shows the reduction in heave motion. Setting the vessel to configuration 1, 2 or 3 also improves heave in extreme sea states with periods of around 14 to 17 seconds. These heave RAOs show substantial improvements in heave motions over the base vessel design. Similar improvements are obtained for the roll and pitch motions of the vessel.

The principle of operation of the motion suppression system when installed on monohulls is slightly different. It is described further below.

FIGS. 8, 9 and 10 show a barge or monohull shape with a layout of internal buoyancy chambers. A chamber 16*a* is provided at the bow end and a chamber 16*b* is provided at the stern end, each chamber being divided into four compartments. These serve to provide heave and pitch alleviation in head seas. Two further chambers 16*c* at the sides of the vessel provide heave and roll alleviation in beam seas. Although not shown, partitions to divide these chambers may also be provided. These chambers are open at their base to the sea (denoted by 17) and have internal water levels (at T) which are at still water level in calm conditions. A volume of air can be trapped above the internal water level by an air valve which can be shut in. If the valve is in the open position, the volume of air above the chamber's internal water level can enter and exhaust freely. The air valves exhaust directly to atmosphere and there are no interconnections via the valves between any of the tanks. The roll mode of motion of the vessel is isolated for explanation of system operation which is based on two physical principles, namely:

(1) Opening or shutting the air valves to the chambers will significantly shift the roll resonance period. By operating the vessel with valves open or valves shut as appropriate, the vessel master can always keep the vessel roll natural period well away from the ocean wave periods exciting the vessel at a particular time or location. Thus, dynamic magnification at roll resonance need never be encountered in any part of the vessel's operating envelope—thus reducing peak roll angles by substantial amounts.

(2) In the valves shut configuration, an additional damping mechanism also reduces roll motion further. The spring/mass dynamic system of the air volume and water column beneath it act as a wave energy generator which radiates energy (in the form of generated ocean waves) away from the vessel. The energy extracted in this way further reduces the motion of the vessel.

The performance of the system is shown by FIG. 14 displaying the roll response amplitude operator against wave period curve for beam seas. It can be seen that the roll response peak is virtually eliminated by operation of the motion suppression system.

A heave response amplitude operator against wave period curve (FIG. 15) for head seas shows the improvement in heave motion response. The motion reduction is less than that obtained for the semi-submersible vessel because the larger water plane area of the monohull vessel induces larger wave forces that need to be compensated. However, the heave reduction performance can be improved further by optimising the dynamics and configuration of the buoyancy chambers.

It should also be said that the reduction in pitch motions obtained with the device are of a similar level to the heave motion reductions.

It will be appreciated that by providing for buoyancy chambers disposed as shown in FIGS. 8 to 10 the vessel can be stabilized against the effects of heave, pitch and roll.

If the stabilization apparatus is used in a conventional ship, it may only be possible to have a pair of open ended chambers spaced lengthwise in the ship. In this case one could protect against heave and pitch but not against roll.

Alternatively, one could have a pair of side-by-side chambers which could counteract roll and heave but not pitch. Yet a further possibility is to have just one buoyancy chamber rather than a plurality thereof, though the range of conditions in respect of which stabilizing can then be provided is even more limited.

Instead of using simple chambers it is possible instead to use chambers in which a piston is movable up and down, the piston separating air above it from water below it. Yet another possibility is to use a chamber whose internal shape may be altered to control the stabilization. For example, an inflatable toroidal bag could be provided on the inside wall of the chamber, inflation and deflation of the bag serving to alter the internal cross-section of the chamber at a given region along its height, thereby affecting in a predetermined way the manner in which the buoyancy of the chamber will vary with varying water level in the chamber.

I claim:

1. A vessel having stabilizing means for alleviating at least heave, comprising at least one chamber disposed to lie at least partly beneath the surface of the water when at least a portion of the vessel is immersed in water, an interface being defined within the chamber between water lying below the interface and air lying above the interface, said chamber having an opening which is adapted to remain open at all times and which communicates with the water to allow the exit or entrance of water out of or into the chamber, and valve means for controlling the buoyancy of said chamber, the valve means being selectively movable to a first position in which said chamber is connected to atmosphere to permit air to enter or leave said chamber in response to the lowering or rising of the water level in said chamber due to wave action, and a second position in which said chamber is not so connected, and control means for controlling said valve means, said control means being operable to maintain said valve means in either one of said first or second positions through a substantial number of wave cycles.

2. A vessel according to claim 1, wherein a plurality of chambers is provided spaced longitudinally from one another with respect to the length of the vessel to provide pitch and heave correction.

3. A vessel according to claim 1, wherein a plurality of chambers is provided spaced laterally from one another with respect to the length of the vessel to provide roll and heave correction.

4. A vessel according to claim 1, wherein the or each chamber is mounted externally in the vessel.

5. A vessel according to claim 1, wherein the or each chamber 1 is mounted internally within the vessel.

6. A vessel according to claim 1, wherein there are a plurality of chambers at least one of which is mounted externally on the vessel and at least one of which is mounted internally within the vessel.

7. A vessel according to claim 1, wherein the chamber or at least one of the chambers is internally partitioned into a plurality of compartments.

8. A method of stabilizing a vessel to alleviate at least heave, which comprises the steps of (a) providing the vessel with at least one chamber disposed to lie at least partly beneath the surface of the water when at least a portion of the vessel is immersed in water, an interface being defined within the chamber between water lying below the interface and air lying above the interface, said chamber having an opening which remains open at all times and which communicates with the water to allow the exit or entrance of water out of or into the chamber, (b) providing valve means for controlling the buoyancy of said chamber, the valve means being selectively movable to a first position in which said chamber is connected to atmosphere to permit air to enter or leave said chamber in response to the lowering or rising of the water level in said chamber due to wave action, and a second position in which said chamber is not so connected, (c) causing the valve means to assume said first or second position in dependence on the periodicity of waves incident on the vessel, (d) maintaining the valve means in the assumed position through a substantial number of wave cycles, and (e) repeatedly executing steps (c) and (d).

* * * * *